US009605453B1

(12) United States Patent
Uyeda et al.

(10) Patent No.: US 9,605,453 B1
(45) Date of Patent: Mar. 28, 2017

(54) DOOR SYSTEM AND CONTROL

(71) Applicants: Alan K. Uyeda, Irvine, CA (US); Michael Wayne Phillips, Upland, CA (US)

(72) Inventors: Alan K. Uyeda, Irvine, CA (US); Michael Wayne Phillips, Upland, CA (US)

(73) Assignee: Syntegra LLC, San Dimas, CA (US)

( * ) Notice: Subject to any disclaimer, the term of this patent is extended or adjusted under 35 U.S.C. 154(b) by 391 days.

(21) Appl. No.: 13/987,952

(22) Filed: Sep. 17, 2013

(51) Int. Cl.

| | |
|---|---|
| ***E05C 1/10*** | (2006.01) |
| ***E05B 65/06*** | (2006.01) |
| ***E05B 65/10*** | (2006.01) |
| ***E06B 7/16*** | (2006.01) |

(52) U.S. Cl.
CPC ..... *E05C 1/10* (2013.01); *E05B 65/06* (2013.01); *E05B 65/1046* (2013.01); *E06B 7/16* (2013.01)

(58) Field of Classification Search
CPC .... B60J 10/08; B60J 10/0062; B60J 10/0065; B60J 10/081; B60J 10/085; B60J 10/0091; B60J 10/083; B60J 10/00; B60J 10/086; E05Y 2900/132; E06B 3/365; E06B 5/164; E06B 7/2316; E06B 7/16; E06B 1/52; E06B 7/2309; E05B 65/0042
USPC ... 49/489.1; 70/447–451, 461, 466, 92, 108, 70/109; 292/92
See application file for complete search history.

(56) References Cited

U.S. PATENT DOCUMENTS 1,974,253 A * 9/1934 Sandor ..... E05C 19/001 70/118
2,752,773 A * 7/1956 Abelson ..... E05B 65/1066 292/52
3,218,678 A * 11/1965 Russell ..... E06B 1/045 49/401
3,374,580 A * 3/1968 Ruff ..... E06B 7/2316 49/470
3,504,456 A * 4/1970 Claud, Jr. ..... E06B 7/16 49/470
3,668,807 A * 6/1972 Thompson ..... E06B 7/18 49/482.1
4,225,163 A * 9/1980 Hubbard ..... E05B 65/1053 292/21
4,320,161 A * 3/1982 Redman ..... E06B 7/231 428/122
4,644,698 A * 2/1987 Gerdes ..... F25D 23/082 312/296
5,014,465 A * 5/1991 Ishikawa ..... E06B 3/88 49/417
5,169,185 A * 12/1992 Slaybaugh ..... E05B 65/1053 292/21
5,471,793 A * 12/1995 Magoon ..... E06B 7/2312 49/482.1
5,638,639 A * 6/1997 Goodman ..... A62C 2/24 292/21

(Continued)

*Primary Examiner* — Suzanne Barrett
(74) *Attorney, Agent, or Firm* — William W. Haefliger

(57) ABSTRACT

In a lockable door system, the combination comprising a door locking first assembly installable in a door for control of operable use to lock or unlock the door, an upper assembly including a locking plunger, and to guide plunger travel upwardly at door top level into locking and unlocking position, an actuator assembly including a rotor rotatable by handle or push bar to control door locking and unlocking, and connecting the rotor with the plunger, and door edge sealing structure.

27 Claims, 6 Drawing Sheets

(56) References Cited

U.S. PATENT DOCUMENTS

| | | | | |
|---|---|---|---|---|
| 6,393,765 | B1 * | 5/2002 | Goldstein | E06B 7/16 49/475.1 |
| 6,641,183 | B2 * | 11/2003 | Brown | E05B 65/1013 292/92 |
| 7,748,757 | B2 * | 7/2010 | Shen | E05B 65/1006 292/92 |
| 8,376,415 | B2 * | 2/2013 | Uyeda | E05C 7/04 292/39 |
| 2008/0150303 | A1 * | 6/2008 | Van Der Kooij | E05C 7/06 292/263 |
| 2009/0139283 | A1 * | 6/2009 | Peng | E05B 65/1013 70/92 |

* cited by examiner

DOOR SYSTEM AND CONTROL

BACKGROUND OF THE INVENTION

This invention relates generally to apparatus enabling reliable in and out use of a door, with enhanced security and safety.

There is continuing need for safety and security at doorways, and for compact door latching installations contributing to security. There is also need for apparatus having unusual advantage in construction, in operation, and providing improved results, as embodied in the present invention, as will be seen.

SUMMARY OF THE INVENTION

It is a major object of the invention to provide improvements in door opening and closing controls, enhancing in and out security at doorways; and to provide improvements in sealing of door edges with doorway frames, and at the meeting edges of pairs of doors.

Basically, door locking and unlocking apparatus embodying the invention includes:

a) a lock actuator assembly sized to fit within a door, and operatively connected to a latch at a door upper edge, with the option of adding a locking bolt at the door lower edge, b) a push bar carried by the door at the door inside and operatively connected to the lock actuator assembly to control unlatching of the latch, c) a handle carried by the door at the door outer side, and operatively connected to the lock actuator assembly, to control unlatching of the door only after positioning of a key to effect unblocking of the actuator assembly, with the option of having the lever or handle always active.

A further object is provision of the actuator assembly to include a first part bodily movable in response to push bar displacement to transmit actuation to a vertically movable latch actuator. As will be seen, the actuator assembly typically includes a rotor operatively connected to the handle and to said first part. The rotor is rotatable to transmit actuation to the latch actuator(s), in response to displacement of said handle, there being means blocking rotor rotation until key turning to unblock the blocking means.

An added object is to provide a clutch, internal to the actuator assembly operatively connected with the rotor to initially resist rotor rotation by the handle and subsequently to allow handle rotation after predetermined torque application as from the door handle at the outer side of the door, thereby allowing handle rotation, once the predetermined torque has been exceeded, not allowing the lock mechanism to open, and protecting the lock mechanism from damage.

Yet another object is to provide a door having an interior space opening only toward a vertical edge of the door, the actuator assembly received in and concealed in that space, the door being free of latching at said door vertical i.e. side edge.

Further objects concern provision of movable door edge structure, which is adjustable to seal off against the door frame in closed position of the door, as at vertically spaced locations along the door vertical edge.

These and other objects and advantages of the invention, as well as the details of an illustrative embodiment, will be more fully understood from the following specification and drawings, in which:

DRAWING DESCRIPTION

FIG. 1 is a front elevation showing a lockable door system, and frame;

FIGS. 1*a* and 1*b* show door latching control units, in a door;

DETAILED DESCRIPTION

Figure 1:
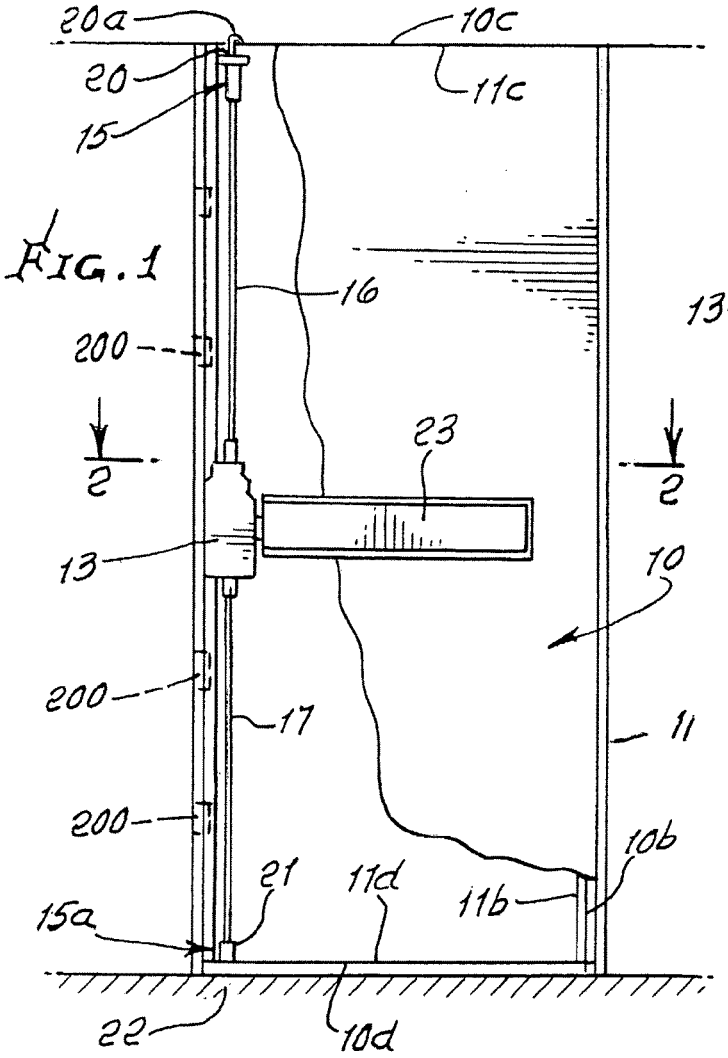
Figure 1A:
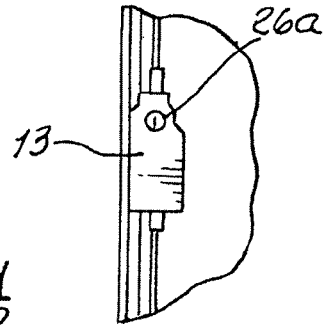
Figure 1B:
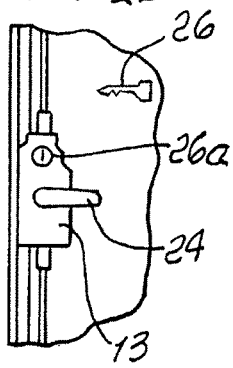
Figure 2:
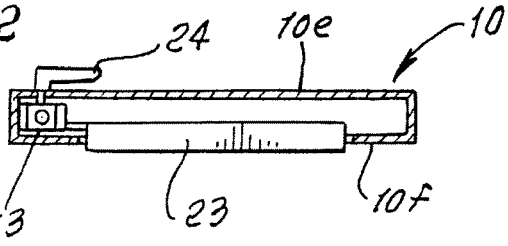
FIG. 2 is a section taken on lines 2-2 of FIG. 1.

In FIG. 1, a door 10 is shown in closed position relative to a door frame 11 having upright edges 11*b*, and upper and lower horizontal edges 11*c* and 11*d*. The door has corresponding edges at 10*b*. A locking control apparatus 13 is located inside the door adjacent door edge 10*a*, and between door panels 10*e* and 10*f*.

Latching structures 15 and 15*a* are located at the top and optionally at the bottom of the door, there being no latching at the door vertical edge 10*a*, for security. Latching control rods 16 and 17 extend vertically inside the door, from apparatus 13 to the latching structures, whereby latch 20 on rod 16 is movable into and out of latching relation with receptacle 20*a* on the doorway upper frame, and latch 21 on rod 17 is simultaneously movable into and out of latching relation with receptacle 22 in the doorway lower frame.

The latch rods are simultaneously movable toward the control unit 13 to unlatch the door, in response to manual pushing of a push bar 23 carried by the door at the inner side of the door; and also in response to turning of a handle 24 carried by the door at the outer side of the door, when handle rotation is unblocked by blocking mechanism within the control apparatus 13, such handle blocking and unblocking being controlled by a key 26 inserted into the door at 26*a*, and rotated, from the outer side of the door. Accordingly, intrusion through the doorway, from the exterior, is key controlled or configured to have an always active lever; whereas escape through the doorway, from the interior, is always available, as by pushing of the push bar.

Figure 5:
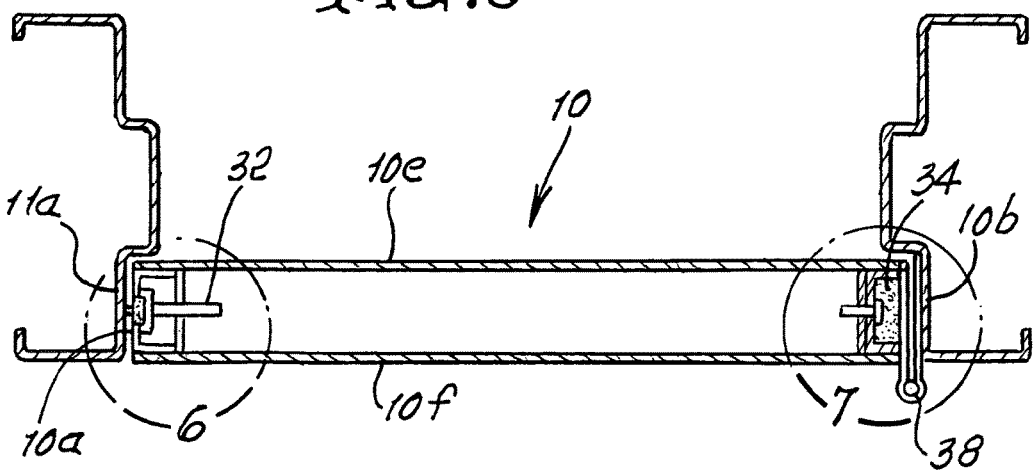
FIG. 5 is a horizontal section taken through a closed door and showing sealing elements.
Figure 6:
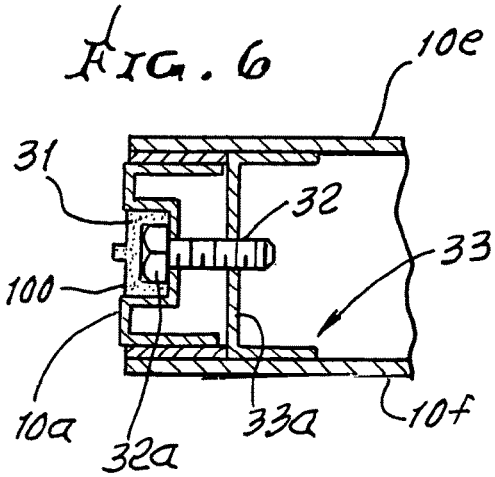
FIG. 6 is an enlarged view taken on lines 6-6 of FIG. 5.
Figure 6A:
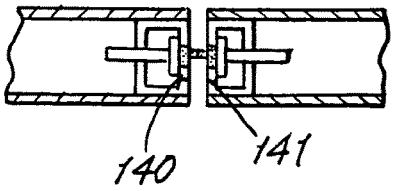
FIG. 6*a* shows two opposed edges of two movable doors.
Figure 7:
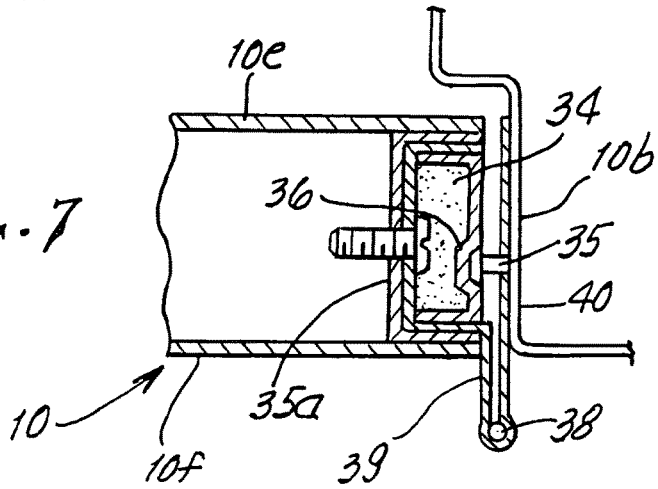
FIG. 7 is an enlarged view taken on lines 7-7 of FIG. 5.

FIGS. 5 and 6 show adjustable door vertical edge 10*a*, with sealing material 100 carried by the door in a recess 31 at the edge. A threaded adjuster 32 engages a carrier 33 having a flanges 33*a* received between door panels 10*e* and 10*f*. The adjuster head 32*a* controllably engages the movable door vertical edge to adjust its position, toward or away from the frame (or opposing door) edge 11*a*, to adjust door sealing upon door closure. Typically, the seal wall is adjusted to contact the frame, in door closed position. Multiple adjustment locations spaced apart vertically, are indicated at 250, in FIG. 1, to seal the gap which may vary in width along door vertical edge. FIG. 6*a* schematically shows similar FIG. 6 structure, employed at opposed edges 140 and 141 of two movable doors, in face to face relation. See also the same or similar structure at FIG. 7, with seal 34 carried by the door proximate the frame edge 10*b*. A stop 35 carried at the frame has a head or flange 35*a* engaging a wall 36 of the door edge to limit and control positioning of the seal 34. Door pivot at 38 controls pivoting of door edge panel 39 relative to doorway frame panel 40.

In the above, latch rods 16 and 17 and latches are held in latching position by cam positioning in the actuator train, until release, and when latch rods are in latch release position, gravitational force exertion on the mechanism holds the rods retracted against movement into distended latching position. This obviates need for springs to hold rods in position, and simplifies overall structure and operation.

Figure 3:
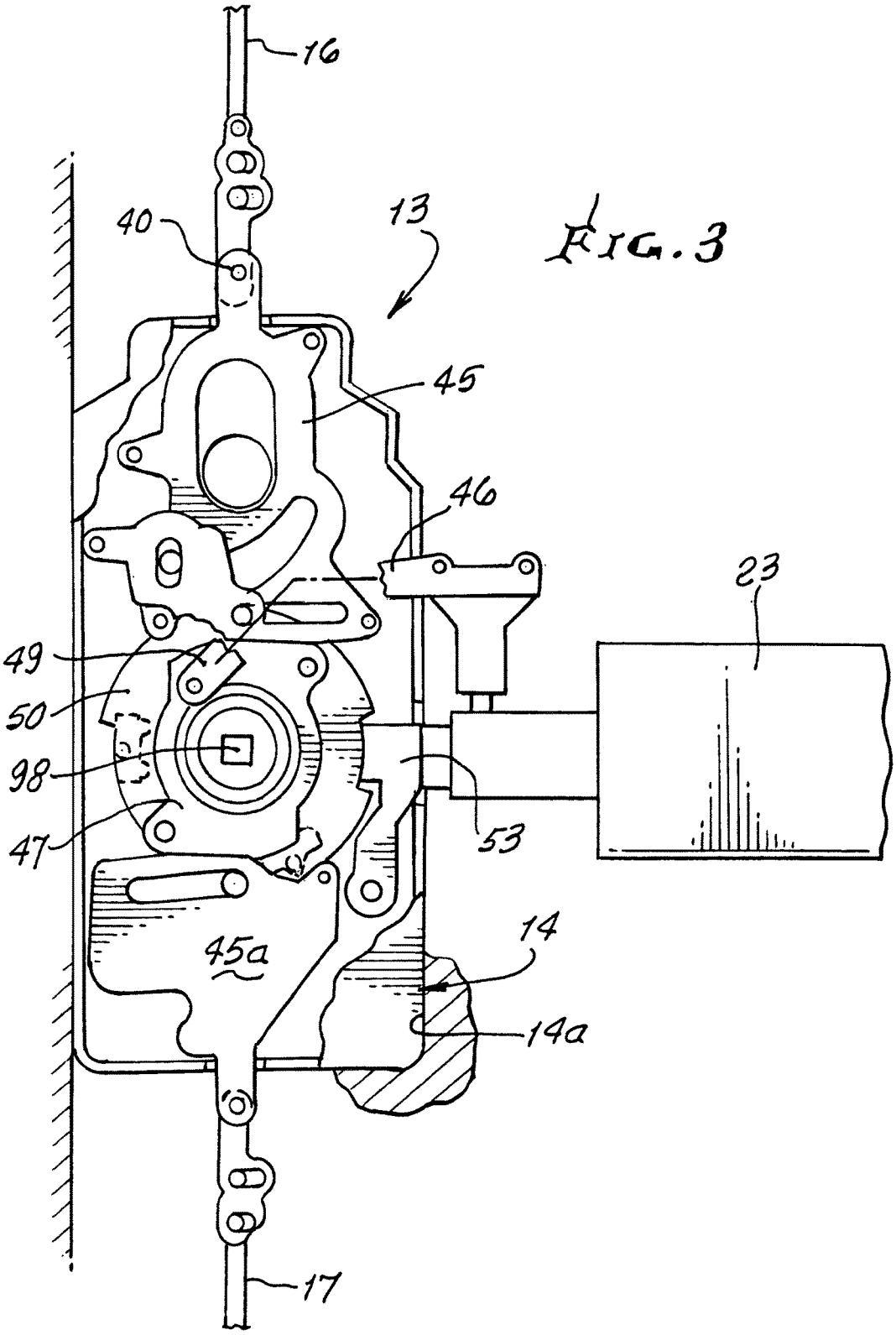
FIG. 3 is an enlarged elevation showing construction of a latching control unit, in closed door latching position.
Figure 4:
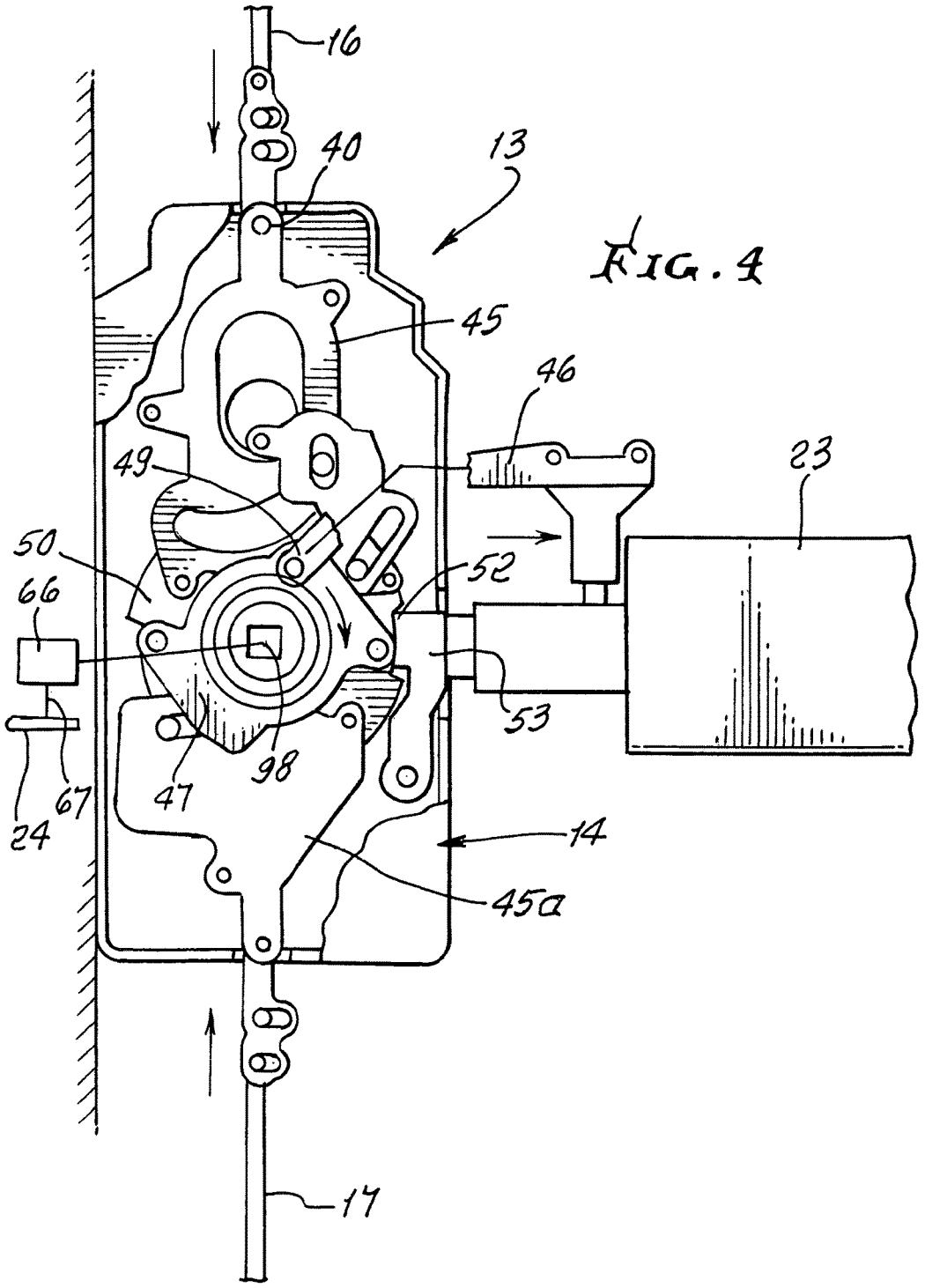
FIG. 4 is a view like FIG. 3, showing the FIG. 3 unit in door unlatched position.

Referring now to FIG. 3 it shows the door latching apparatus 13 in door locked or latched position, and to FIG. 4 showing 13 in door unlatched position. It includes a receptacle 14 fitting in door recess 14*a*, and containing control elements operatively connected to the latch rods 16 and 17.

Actuator plate 45, connected at 40 to latch actuator rod 16, is displaced downwardly in response to rightward movement of link 46 caused by pushing of the push bar 23, as can be seen in FIG. 4. This occurs in response to clockwise pivoting movement of link 47 about axis 98. In this regard, link 46 is coupled at 49 to rotor 50 rotate it clockwise, to displace 47 to FIG. 4 position, causing 45 to be displaced downwardly, and plate 45*a* to be displaced upwardly.

If external handle 24 is rotated manually, it likewise causes rotor 50 to rotate clockwise; however, the handle cannot rotate if actuator 51 coupled to 50, is blocked, as at location 52 in FIG. 4, by lever 53. Turning of the key 26 in slot 26*a* serves to unblock rotation of 51, by limited rightward rotation of lever 53.

If rotation of handle 24 is blocked and excess torque is applied, provision is made for disengagement of a coupler in the handle torque transmission path. This is shown, schematically, by coupler 66, in FIG. 4, coupled to handle 24 at 67, and to rotor 50.

Figure 8:
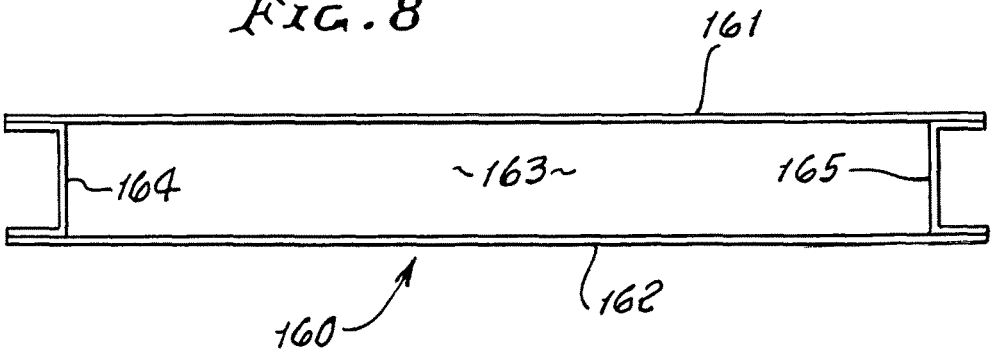
FIGS. 8 and 9 are sections showing door structure, and in relation to hinging and frame structure.
Figure 9:
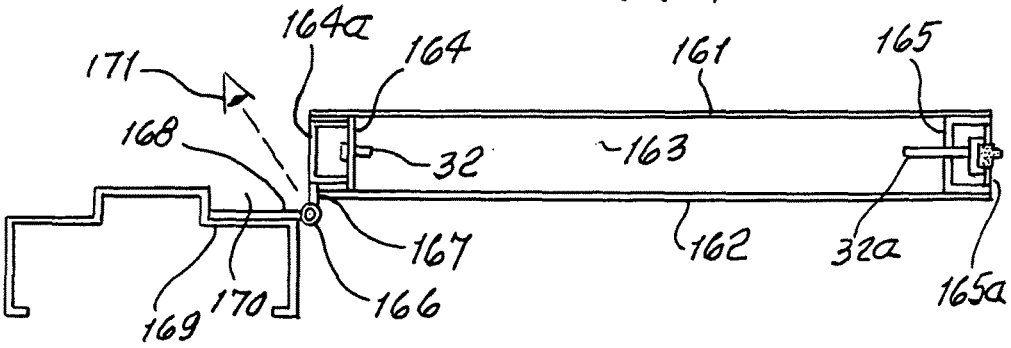

In FIG. 8, a modified door 160 has front and rear vertical panels 161 and 162, and door interior 163. Channel shaped receptacles 164 and 165, U-shaped in section, fit between the panels, and open oppositely endwise to receive sealing structure as shown in FIG. 6. FIG. 9 also shows the receptacles as well as adjustable door edge sealing elements 32 and 32*a*, and sealing walls 164*a* and 165*a*. The receptacles are box shaped as shown and move toward or away from frame edges as threaded adjusters 32 and 32*a* are rotatably adjusted. A hinge 166 has plate connection at 167 to receptacle 164 and at 168 to door frame 169. When the door is closed and receptacle 164 is closed into frame space 170, the hinge is concealed from eye view 171.

Figure 10:
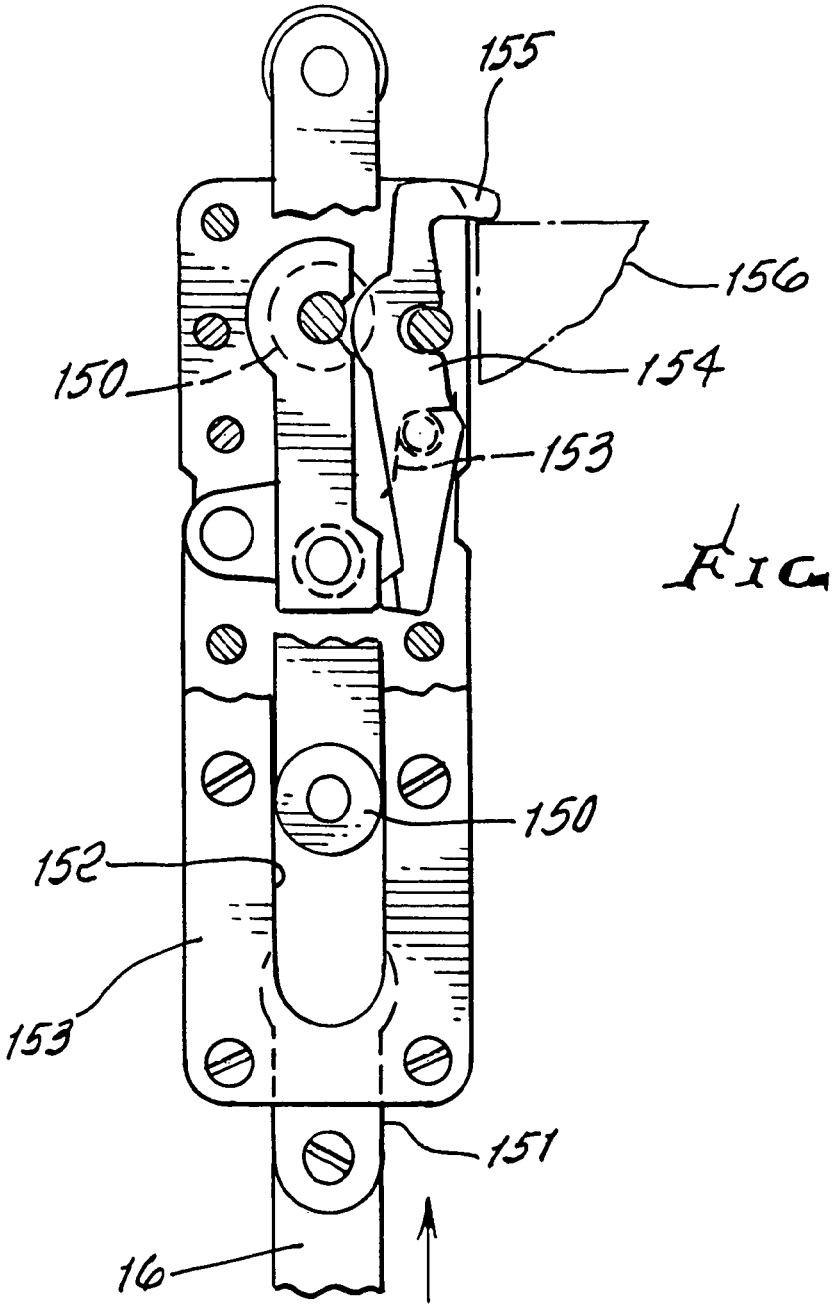
FIG. 10 is a view showing roller assisted latching at the upper edge of the door.

In FIG. 10, rollers or guides 150 are carried by latch plate 151 moved up and down by latch rod 16, in guide slot 152 in plate 152*a* attached to the door. Spring 153 holds arm 154 in pivoted position, with protrusion 155 engaging frame 156, blocking release of downward travel of rod 16, until that rod is pulled downward.

We claim:

1. In a lockable door system, the combination comprising a) a door locking first assembly installable in a door for control of operable use to lock or unlock the door, b) friction limiting upper latch assembly including a locking plunger, and means to guide plunger travel upwardly at door top level into locking and unlocking position, there being means guiding said travel, c) said first assembly including a rotor rotatable by handle or push bar to control door locking and unlocking, and means connecting said rotor with said plunger, d) a door frame and door edge sealing means which is adjustable, to seal off against the door frame, and/or at the meeting point of two opposing doors in a pair, in closed position of the door, e) there being a stop carried by the frame and engaging said sealing means to limit and control positioning thereof, f) the door having parallel upright elongated channels at opposite upright door edges, g) and a door hinge having a channel shaped member operatively connected to and received in one of said elongated channels, and a hinge arm facing said channel shaped member and one of said door channels, in door closed position, there being a fastener interconnecting the hinge channel shaped member and a door channel shaped member and projecting within a channel defined by said door channel shaped member.

2. The combination of claim 1 including a key operated means for controlling said rotor rotation.

3. The combination of claim 1 including means operable to initially resist rotor rotation and subsequently to allow rotor rotation after pre-determined torque application to the rotor, as from the door handle at the outer side of the door, there being protective means adjacent and facing said channel shaped arm and the door frame.

4. The combination of claim 3 wherein the door has external and internal manually operable controls.

5. The combination of claim 4 wherein one of said controls is an external handle.

6. The combination of claim 4 including means sized to determine the level of said pre-determined torque application.

7. The combination of claim 6 including an element located to disconnect the handle from the rotor, at said pre-determined torque application level.

8. The combination of claim 1 wherein said door edge sealing means which is adjustable, to seal off against the door frame, and/or at the meeting point of two opposing doors in a pair, in closed position of the door.

9. The combination of claim 1 wherein the sealing means include an integrated sealing surface located to have substantial contact with the door frame, or opposing door, in said door closed position.

10. The combination of claim 1 wherein said means that connects the rotor with the plunger includes rotary cam structure configured to progressively urge said plunger upwardly in response to handle turning, operating to rotate said rotor.

11. Door locking and unlocking apparatus comprising a) a lock actuator assembly sized to fit inside a door, and operatively connected to a latch at a door upper edge, b) a push bar carried by the door at the door inside and operatively connected to the lock actuator assembly to control unlatching of the latch, c) a handle carried by the door at the door outside, and operatively connected to the lock actuator assembly, to control unlatching of the door only after positioning of a key to effect unblocking of the actuator assembly, d) adjustable door edge sealing means to seal off against the door frame, and/or at the meeting point of two opposing doors in a pair, in closed position of the door, e) means for turning of the handle in response to failure or absence of key turning, f) and a door hinge having an arm anchored thereto by said adjustable door edge sealing means, said arm having an anchoring channel shaped concealed portion.

12. The apparatus of claim 11 wherein the actuator assembly includes a first part bodily movable in response to push bar displacement to transmit actuation to a vertically movable latch actuator.

13. The apparatus of claim 11 wherein the actuator assembly includes a rotor operatively connected to the handle and to said first part.

14. The apparatus of claim 11 including a rotor rotatable to transmit actuation to said latch actuator, in response to displacement of said handle, there being means blocking rotor rotation until key turning to unblock said blocking means.

15. The apparatus of claim 11 including a door having an interior space opening only toward a vertical edge of the door, said actuator assembly received in and concealed in said space, said door being free of latching at said door vertical edge.

16. The apparatus of claim 11 including adjustable sealing means at the door edge, for controlling sealing to a door frame in door closed position.

17. The apparatus of claim 11 including means for turning of the handle in response to failure or absence of key turning.

18. The apparatus of claim 11 wherein said means for turning of the handle has a disengaged position to provide said limiting.

19. In a lockable door assembly, the improvement comprising a) the door having parallel upright elongated channels at opposite upright door edges, b) the door having at least one of the following:

i) adjustable means in one of the channels for sealing with a door frame edge lengthwise of the one channel, ii) adjustable means in both of the channels for sealing with door frame edges lengthwise of both of the channels, c) and a concealed door hinge associated with said adjustable means, and having an arm with a concealed, anchored, channel shaped portion.

20. The improvement of claim 19, wherein the hinge is located at a corner defined by the door frame.

21. The improvement of claim 19 wherein at least one of said sealing means includes a receptacle fitting into at least one of the channels, and sealant in the receptacle.

22. The improvement of claim 21 including a door frame edge toward which the receptacle pivots about a concealed hinge axis as the door pivots above said axis, and including said hinge.

23. The improvement of claim 19 including a second door having an upright elongated channel and sealing means in the second door channel.

24. The system of claim 1 wherein said locking plunger guide means is located to guide travel of the plunger into said locking and unlocking positions whereby force exerted on the door does not frictionally prevent said travel.

25. The combination of claim 1 wherein the system is configured to be fire resistant.

26. In a lockable fire resistant door system, the combination comprising:

a) a door locking first assembly installed in a fire resistant door for controlling door locking and unlocking, b) said first assembly including a multi-stage ratcheting locking mechanism operable to prevent the door from remaining ajar when unlocked, said mechanism includes at least one of the following operators:

i) recessed push bar ii) handle iii) key, there being friction limiting elements within said mechanism to reduce required door opening force and to extend operational life, c) a door edge sealing means for sealing off against at least one of the following:

i) the door frame, ii) meeting structures defined by two opposing doors in a pair in door closed position in which the doors remains fixed in adjacent position to prevent incursion of smoke and/or flames, d) a door hinge, and means to conceal the hinge within door structure, to enhance security.

27. The system of claim 26 wherein the hinge has an arm defining a channel shaped portion.

* * * * *